US007301115B2

(12) United States Patent
Elliot et al.

(10) Patent No.: US 7,301,115 B2
(45) Date of Patent: Nov. 27, 2007

(54) SYSTEM AND METHOD OF IDENTIFYING AND SORTING RESPONSE SERVICES MAIL PIECES IN ACCORDANCE WITH PLURAL LEVELS OF REFINEMENT IN ORDER TO ENHANCE POSTAL SERVICE REVENUE PROTECTION

(75) Inventors: Russell Elliot, Endicott, NY (US); Keri C. Ovando, Apalachin, NY (US); Jeffrey S. Poulin, Endicott, NY (US); Robert Strebel, Endwell, NY (US)

(73) Assignee: Lockheed Martin Corporation, Bethesda, MD (US)

( * ) Notice: Subject to any disclaimer, the term of this patent is extended or adjusted under 35 U.S.C. 154(b) by 550 days.

(21) Appl. No.: 10/897,853

(22) Filed: Jul. 23, 2004

(65) Prior Publication Data

US 2005/0027392 A1 Feb. 3, 2005

Related U.S. Application Data

(60) Provisional application No. 60/492,444, filed on Aug. 1, 2003.

(51) Int. Cl.
*B07C 5/00* (2006.01)

(52) U.S. Cl. ..... 209/584; 209/900; 700/224; 382/101; 705/402

(58) Field of Classification Search ..... 209/584, 209/900; 382/101, 102; 700/223–227; 705/402, 404, 409, 410
See application file for complete search history.

(56) References Cited

U.S. PATENT DOCUMENTS 4,607,433 A 8/1986 Meeker
4,780,835 A 10/1988 Sievel et al.
4,796,193 A 1/1989 Pitchenik
5,293,319 A 3/1994 DeSha et al.
5,420,403 A * 5/1995 Allum et al. ..... 235/375
5,655,023 A 8/1997 Cordery et al.

(Continued)

FOREIGN PATENT DOCUMENTS

WO WO 92/08618 5/1992

(Continued)

*Primary Examiner*—Patrick Mackey
*Assistant Examiner*—Mark Hageman
(74) *Attorney, Agent, or Firm*—Louis J. Franco; Leland D. Schultz; Patrick M. Hogan

(57) ABSTRACT

A method to reduce lost postal revenue by identifying and sorting a mail piece by determining whether algorithmically-resolved image data corresponding to the mail piece indicates that the mail piece is business reply mail. The method is facilitated in part by maintaining data related to each business reply customer account. The business reply customer data is consulted and compared to a predetermined set of criteria to ascertain if the possibly incomplete, incorrect, or ambiguous data discernable from the captured image of the mail piece is indicative of, at a minimum, that the mail piece is business reply for the purpose of sortation to an appropriate business reply collection point, and in addition, that a high-confidence match to a customer account can be obtained for the purpose of automated charge assessment. Machine-readable sortation signals are generated in accordance with the most refined level of sortation indicated by the consultation.

20 Claims, 8 Drawing Sheets

U.S. PATENT DOCUMENTS

| | | | | |
|---|---|---|---|---|
| 5,825,893 | A | 10/1998 | Kara | |
| 6,233,568 | B1 | 5/2001 | Kara | |
| 6,459,953 | B1 * | 10/2002 | Connelly et al. | 700/224 |
| 6,775,590 | B2 * | 8/2004 | Pintsov et al. | 700/224 |
| 6,793,136 | B2 * | 9/2004 | Wells et al. | 235/385 |
| 6,804,577 | B2 * | 10/2004 | Ferrara et al. | 700/224 |
| 6,832,130 | B2 * | 12/2004 | Pintsov et al. | 700/224 |
| 7,095,875 | B2 * | 8/2006 | Rundle et al. | 382/101 |
| 7,131,572 | B2 * | 11/2006 | Miller et al. | 235/375 |
| 2003/0093389 | A1 | 5/2003 | Critelli et al. | |
| 2003/0163421 | A1 * | 8/2003 | Van Ness et al. | 705/40 |

FOREIGN PATENT DOCUMENTS

| | | |
|---|---|---|
| WO | WO 02/065409 | 8/2002 |

* cited by examiner

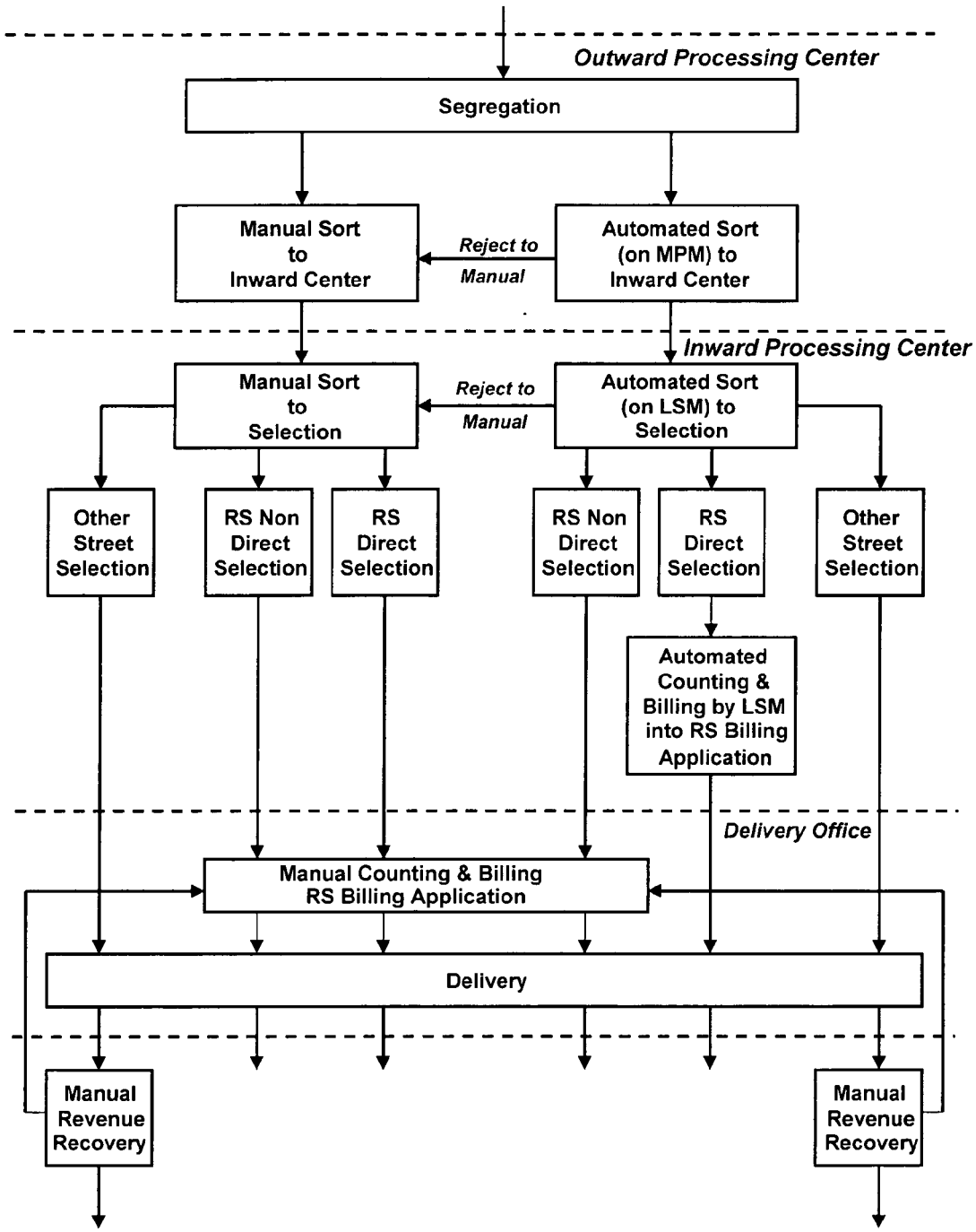
*FIG. A*
*(Background)*

FIG. B
(Background)
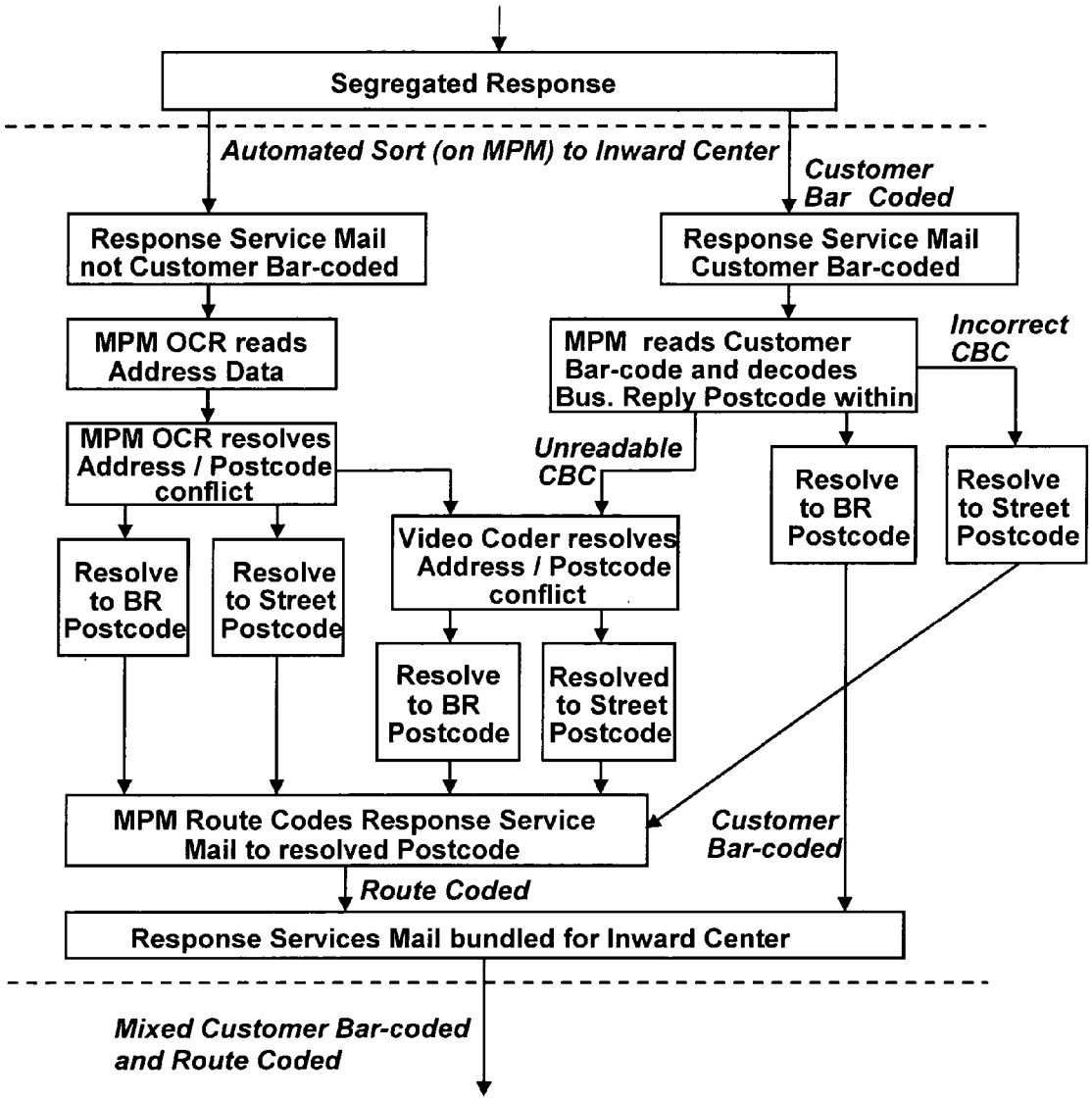

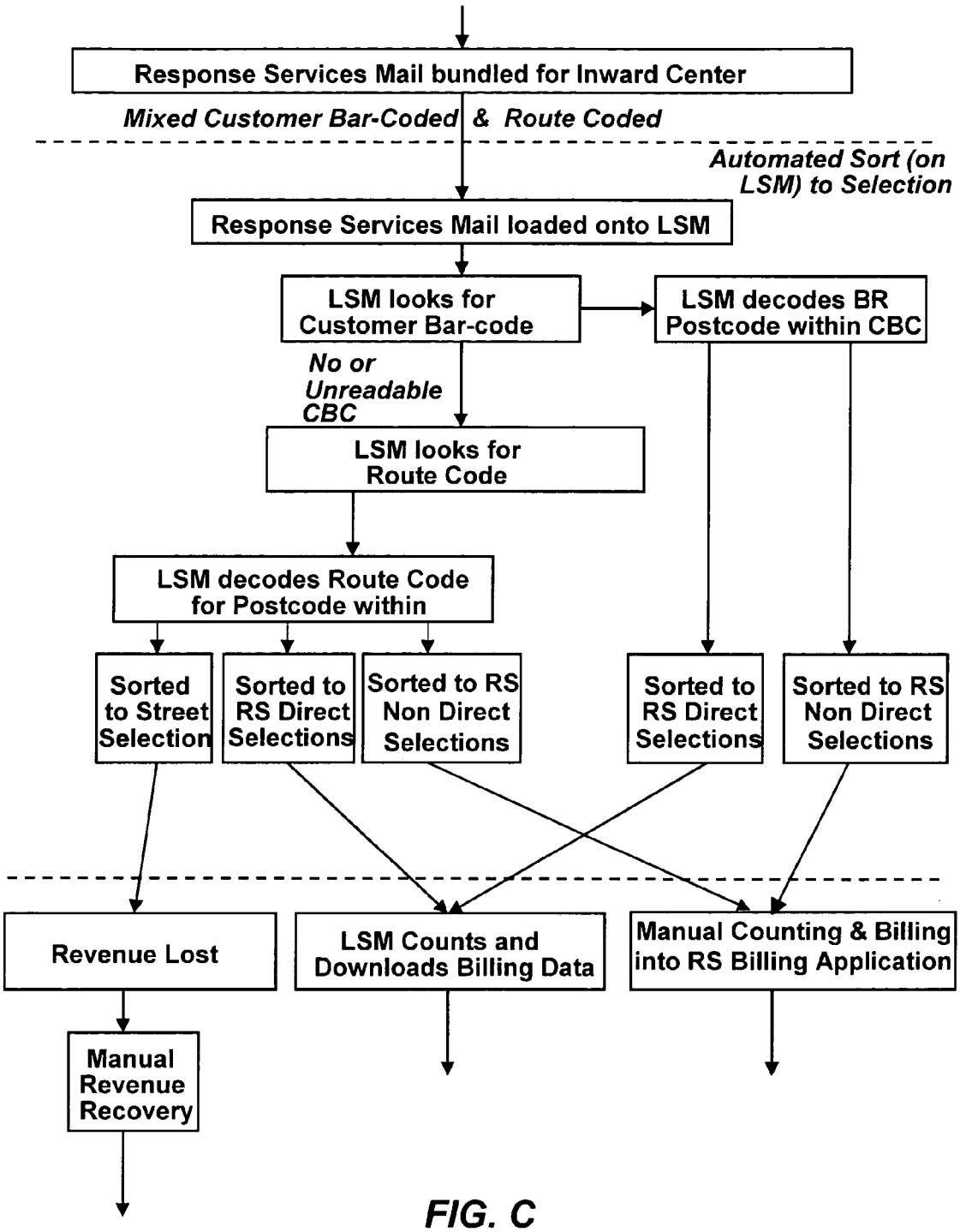
*FIG. C*
*(Background)*

| Bus. Reply Lic. No. | RS Postal Code | Street Address Postal Code | Postal Customer's Account ID | Mail Class | Shared Collect Point | Issuing Facility |
|---|---|---|---|---|---|---|
| 1000 | 20232 | 20231 | 003001 | 1 | 0 | D.C. |
| 1000 | 02111 | 02109 | 003016 | 1 | 0 | Boston |
| 1000 | 90211 | 90210 | 014732 | 2 | 1 | Los Angeles |
| . . . . | . . . . . | . . . . . | . . . . . | .. | | |
| 1837 | 23286 | 23295 | 006789 | 1 | | Richmond |
| 1422 | 23286 | 23295 | 007812 | 2 | | Richmond |
| 1501 | 23286 | 23288 | 011689 | 1 | | Richmond |
| . . . . | . . . . . | . . . . | | | | |
| 30 | 79998-8845 | 79994 | 1A0001 | 1 | 0 | El Paso |
| . . . . | . . . . . | | | | | |
| 20 | 79995-2233 | 79994 | 1B0002 | 1 | 1 | El Paso |
| 18 | 79995-2233 | 79994 | D60006 | 1 | 1 | El Paso |
| . . . | . . . . . | | | | | |

*FIG. 4*

160

FIG. 5

| | |
|---|---|
| Mail piece exhibits valid BRS PC, License No. and class corresponding to a unique account ID, shared = 0 **183A** | |
| Mail Piece Customer Bar Code exhibited and validated, shared = 0 **183B** | |
| Mail piece exhibits valid BRS PC with single occurrence in Lic. File, class matches, lic. no. is valid, but does not match, shared=0 **183C** | **182** |
| Mail piece exhibits street PC, not BRS PC, lic no., class and street PC indicate unique record, PC correctable to RSPC, shared =0 **183D** | |
| . . . . . | |
| | |
| | |
| . . . . . | |
| Mail piece exhibits valid BRS PC, License No. and class corresponding to a unique account ID, shared = 1 **185A** | |
| Mail Piece Customer Bar Code exhibited and validated, shared = 1 **185B** | |
| Mail piece exhibits valid BRS PC with single occurrence in Lic. File, class matches, lic. no. is valid, but does not match, shared=1 **185C** | **184** |
| Mail piece exhibits street PC, not BRS PC, lic no., class and street PC indicate unique record, PC correctable to RSPC, shared =1 **185D** | |
| . . . . . | |
| . . . . . | |
| Mail piece exhibits a street PC, no lic. No. obtainable from mail piece **187A** | |
| Mail piece exhibits a street PC with a mail class match, lic no. not valid **187B** | **186** |
| Mail piece exhibits street PC, no mail class match, lic. no. not valid **187C** | |
| Mail piece exhibits street PC, no mail class match, lic. no. valid, but does not match **187D** | |
| . . . . . | |
| | |

Unique, "dedicated" business reply account identified, generate sortation signals consistent with sortation of corresponding mail piece to dedicated collection point in accordance with BRS PC Unique business reply account identified, generate sortation signals consistent with sortation of corresponding mail piece to the appropriate "non-anonymous" shared collection point in accordance with BRS PC Unique business reply account not identifiable, generate sortation signals consistent with "anonymous" sortation of corresponding mail piece to the appropriate shared collection point in accordance with BRS PC nearest the indicated street PC

SYSTEM AND METHOD OF IDENTIFYING AND SORTING RESPONSE SERVICES MAIL PIECES IN ACCORDANCE WITH PLURAL LEVELS OF REFINEMENT IN ORDER TO ENHANCE POSTAL SERVICE REVENUE PROTECTION

PROVISIONAL PRIORITY CLAIM

Priority based on Provisional Application Ser. No. 60/492,444, filed Aug. 1, 2003, and entitled "SYSTEM AND METHOD OF SORTING RESPONSE SERVICES MAIL PIECES IN ACCORDANCE WITH PLURAL LEVELS OF REFINEMENT IN ORDER TO ENHANCE POSTAL SERVICE REVENUE PROTECTION," is claimed.

BACKGROUND

Individuals, institutions, and post office employees introduce items of mail into the postal system at local post office branches. Once the receiving post office branch is in possession of a mail piece, the mail piece begins a journey through a highly organized system. Mail received into the postal system at a local branch office is eventually transported to a centralized postal hub. There are in excess of 250 postal hubs in the United States. These "hubs" are known by alternative names including (i) processing and distribution centers, (ii) general mail facilities and (iii) mail distribution centers. Postal hubs are regional mail centers that service individual post office branches within a particular range of ZIP Codes. Typically, a postal hub services one or more "three-digit ZIP Code areas." For example, the Central Massachusetts Processing and Distribution Center (also known as the "Worcester Facility") services the local post office branches situated in all the ZIP Codes beginning with "014", "015," "016," and "017." That is, mail destined for or departing from a local branch office within a ZIP Code beginning with any one of the four sets of three digits in the previous sentence will, under normal circumstances, pass through the Worcester facility. The Worcester facility services more than two dozen towns, each with its own local branch office. The 250 plus hubs in the United States collectively service approximately five thousand individual postal branch offices.

Mail coming into and going out of the various local branch offices in a particular geographic region is processed through one or more hubs before delivery to its final destination. For instance, a mail piece originating in Southbridge, Mass. (01550) and destined for Littleton, Mass. (01460) is processed through the Worcester facility only (i.e., a single hub), because the ZIP Code of origin and the destination ZIP Code are both serviced by the Worcester hub. However, in many instances, a mail piece is processed through two hubs between the time of its introduction into the system and its ultimate delivery to an addressee. This is the case, for instance, when a mail piece is received at a branch office that is not serviced by the same hub that services the branch office responsible for delivery of the mail piece to the intended recipient. In such a case, a mail piece received at a branch office is transported to an "outgoing hub" where the mail piece is sorted and routed for transportation to an "incoming hub." The incoming hub is the hub that services the local branch office responsible for delivery of the mail piece to the intended recipient. For example, a mail piece originating at Littleton, Mass. (01460) and destined for Owego, N.Y. (13827) is transported from Littleton, Mass. to the Worcester, Mass. facility (i.e., the outgoing hub). At the Worcester facility, the mail piece is sorted and deposited on an appropriate vehicle for transport to the postal hub at Binghamton, N.Y. (i.e., the incoming hub) because the Binghamton hub services the local post office branches beginning with "137," "138," and "139." Once delivered to the Binghamton hub, the mail piece is sorted and delivered to the local, Owego, N.Y. branch office (13827) from which it is transported to the mailbox of the addressee, for example.

Mechanical, electronic and computer apparatus enable postal clerks to process large volumes of mail each day. Larger postal facilities (e.g., hubs) are equipped with rigid containers, bins on wheels, conveyor belts, forklifts, cranes, and other machinery to facilitate the handling of large quantities of mail. There are also segregating machines to separate a mixture of mail into different types.

Some first-class mail is precancelled. If not precancelled, mail pieces must go through a facer-canceler machine. Such a machine can process tens of thousands of letters an hour. Facing is the process of aligning letters so that the address side is facing the canceler, with the stamps, or other postage-related information (e.g., an indication that the depositor need not apply postage), in the same corner. The machine prints wavy black lines over the stamp, for example, canceling it so that it cannot be used again. Alongside the stamp is printed a circle containing the date, place, and time of stamping. The circle and wavy lines constitute the letter's postmark. Typically, mail pieces are canceled at a hub.

After postmarking is completed, mail pieces are ready to be sorted according to destination. Traditionally, clerks sorted mail pieces by hand according to destination, using racks of pigeonholes, called distribution cases. Increasingly, however, the sorting process has been automated.

The United States introduced ZIP (Zone Improvement Plan) Codes in 1963. Users of the mail service place a five-digit number (ZIP Code) at the end of the address. The first three digits identify the section of the country to which the mail piece is being sent, while the last two identify the specific post office or zone at the destination. ZIP Codes enable the use of optical and electronic reading and sorting equipment.

In the 1980's the United States Postal Service introduced a voluntary nine-digit ZIP Code system. Four additional digits were added to the original ZIP Code after a hyphen to speed automated sorting operations. Of the four additional numbers, the first two indicate a specific sector of a city or town such as a cluster of streets or large buildings. The second two numbers represent an even smaller segment such as one side of a city block, one floor of a large building, or a group of post office boxes.

Increasingly, tasks once performed manually are now performed mechanically, electronically and by computers. For instance, destination addresses once read by human beings who sorted mail pieces into compartments based on destination city, for example, are now read by machine (e.g., scanned by optical character recognition apparatus). An image of a destination address is captured and stored in computer memory. Character recognition algorithms analyze the captured image and resolve it into a string of alphanumeric data to generate signals that instruct sorting machines where to route individual mail pieces. Such systems have dramatically increased the efficiency of the postal system and the overall volume of mail that the system can handle.

Despite the technological advances of recent decades, postal management is still largely concerned with the efficient administration and deployment of large bodies of manpower, the organization of large transport fleets, many aspects of property management, and financial and economic problems, including revenue protection against unpaid or underpaid postage. Automation and computer technology have increasingly been exploited as a management aid with the realization that the postal, service operates within a commercial market where competition from private companies can be fierce and efficiency is the watchword.

A significant loss in postal revenue is associated with erroneous and fraudulent use of business reply mail licenses and postcodes. More specifically, business reply mail pieces consist, for example, of addressee-postage-paid postcards and envelopes that can be mailed by customers or prospects of the business reply postal customer free of charge to such customers and prospects. The business reply system is essentially a mechanism for "reversing the charges" from the sender to the recipient. In order for a business to be entitled to receive business reply mail, the business must (i) purchase a license, the number of which must appear on each mail piece to be received under that license and (ii) use a specific business reply postcode so that the business reply mail can be identified, tracked and counted by the postal service for subsequent billing to the business. In the United States, the license number is typically expressed as a permit number on the face of a postcard or envelope. When incorrect information appears on the face of a business reply mail piece revenue is lost because the postal service delivers, or makes attempts to deliver, the mail piece without any means of billing for the service.

Increasingly, but still on only about 20 percent of all business reply mail, at least postal code information is encoded in a customer bar code (also referred to as a customer locator code) that is typically printed on the front of a business reply mail piece. Currently, the customer bar code is a shorthand, machine readable indication, applied by the customer, as to the postal code information appearing on the front face of a business reply mail piece in addition to other information. The current practice of the postal system is to simply accept the information encoded in a customer bar code as true and accurate when it appears on a mail piece. To the extent that the postal code in the customer bar code and the human readable postal code on the front face of a business reply mail piece are contradictory, the default position is to accept the customer bar code as accurate. This approach is understandable from a statistical standpoint because human beings are typically going to be disconcerted by seeing a business reply postal code that does not match what they know to be their street postal code on the front face of the mail pieces; they will simply believe a mistake has been made and "correct" the "misinformation" to the street postal code with which they are comfortable. "Blind" encoding of the proper business reply postal code obviates erroneous attempts at "correction." It will be appreciated that incorrect or incomplete encoding of such bar codes, combined with the postal system's complete reliance on the information contained therein, is another source of postal revenue loss.

Some large businesses are assigned a dedicated business reply postal code, while other, smaller businesses share a business reply postal code with other businesses serviced, for example, by the same postal hub. As previously indicated, a business reply postcode does not correspond to a street address and is therefore distinguishable from a street address postal code. It is the intent of the postal service that business reply mail destined for an entity to which a dedicated business reply postal code has been assigned is sorted to a dedicated collection point (e.g., a receptacle such as a sack or bin) within, for instance, a postal hub nearest the delivery point. That is, only business reply mail intended for such a large entity is properly routed to a collection point dedicated to that entity. Once collected, the mail pieces are counted and the corresponding postal charges are assessed to the entity to which the collection point is dedicated.

Distinguished from a dedicated collection point is a shared collection point that receives business reply mail destined for multiple (i.e., at least two) business reply mail license holders, for example. Periodically, a human being removes mail pieces from the shared collection point, sorts them according to postal customer and assesses the appropriate charges to the appropriate postal customers based on quantity, class, etc. It will be appreciated that mail sorted to a shared business reply mail collection point is sorted with a lower degree of refinement than mail sorted directly to a dedicated business reply collection point. Once business reply mail pieces have been counted, and the appropriate charges assessed, the mail pieces are delivered to the post office boxes or street addresses of the postal customers to which they are destined in the ordinary course.

A common reason that revenue is not collected for the delivery of business reply mail pieces is that businesses erroneously apply to their business reply mail the street postal code corresponding to the physical location of the business, or the business's post office box, as opposed to the business reply postcode assigned to the business under the terms of a license agreement. Other reasons include the application of an incorrect or invalid license number and erroneous indications as to the class according to which mail pieces should be delivered (e.g., first class instead of second class, etc.). Currently, reliable automated processing and revenue recovery depends heavily on a postal customer's application of accurate information on the face of business reply mail associated with that customer and, where applicable, correct use of a customer-applied bar code. Accordingly, innocent mistakes as well as intentional efforts to defraud the postal system, result in mail pieces escaping the automated revenue protection mechanisms. Various manual protection schemes have been devised and implemented in accordance with which humans are relied upon to identify mail pieces that circumvent current automated revenue recovery processes. Manual systems, however, even if they could be characterized as reliable, are extremely costly.

FIGS. A, B and C are operational flowcharts illustrative of current mail flow and sortation through an outward processing center (i.e., an outgoing mail facility), an inward processing center (i.e., an incoming mail facility) and a delivery office (i.e., local branch office) serviced by the inward processing center. Although the depictions were originally produced to indicate business reply mail flow through the English mail system, the model, for all intents and purposes, obtains equally to the U.S. Mail system and to other systems throughout the world. Combined, the three drawings provide an indication as to where and when manual handling occurs and how revenue is lost.

Referring to FIG. A, business reply mail pieces are first segregated for handling separately from pre-paid postage mail, for example. Each business reply mail piece is then introduced onto a mail processing machine (MPM) in the outward processing facility for automated sortation to the appropriate inward mail center. If the automated mail processing machine is unable to sort a mail piece because, for example, the address interpretation programs are unable to decipher the address information in an acquired image of the mail piece, the mail piece is rejected to a manual sort area for sorting to the proper inward mail center. The mail sorted at the outward facility, whether automatically or manually sorted, is then loaded onto transport vehicles destined for various inward processing facilities.

At an inward processing facility, business reply mail pieces are sorted in accordance with a higher (i.e., more specific) level of sortation refinement, both manually and by automated mail processing machines, than the refinement schemes with which they are sorted at the outward facility. Mail pieces that are sorted automatically by a letter sorting machine (LSM) for transport to local delivery branches are sorted to various collection points within the inward facility. Three general types of routes to collection points labeled in FIG. A are "RS Direct Selections," "RS Non-Direct Selections," and "Other Street Selections." The "RS Direct Selections" designation represents the routing of business reply mail pieces destined for business reply customers with whom a dedicated collection point is associated and whose positive identification has been facilitated by the display of complete and accurate information on the corresponding mail piece including accurate use of a business reply services postal code, proper display of a business reply license number and, where applicable, an accurate customer-applied bar code, for example. In some facilities, automated mail-piece counting and billing is applied before the sorted mail pieces are transported to the proper delivery office (i.e., local post office branch) for ultimate delivery to the customer.

The "RS Non-Direct Selections" designation represents the routing of business reply mail pieces to shared collection points. Mail pieces sorted to a shared collection point are transported wholesale (e.g., in one or more shared receptacles) to the appropriate delivery office where they are manually separated and counted and appropriate charges are manually assessed to corresponding postal customers.

The designation "Other Street Selections" represents the routing of business reply mail pieces for which insufficient information is accurately decipherable to sort and route in accordance with either a dedicated collection bin or a shared collection bin represented by the "RS Non-Direct Selections" designation. In other words, mail pieces routed to "other street selections" is collected at what amount to collection points for mail not recognizable as conforming business reply mail. A large percentage of such mail pieces is routed directly to local postal branches for delivery in accordance with street address information and bypasses all revenue collection schemes.

Referring still to FIG. A, manually sorted business reply mail pieces are similarly routed in accordance with "RS Direct Selection," "RS Non-Direct Selections," and "Other Street Selections" designations. On the manual side, however, mail collected at both dedicated and shared collection points is routed for manual counting, final-delivery sorting and customer account charge assessment. As with the mail routed to "Other Street Selections" under the automated scheme, mail routed to "Other Street Selections" under the manual scheme simply bypasses revenue collection schemes at the delivery office.

FIG. B is a more detailed schematic representation of the flow of business reply mail through automated sortation in the outward processing center of FIG. A and FIG. C is a more detailed schematic representation of the flow of business reply mail through automated sortation in the inward processing facility. It will be appreciated from the preceding description and FIGS. A, B and C that heavy reliance is placed upon manual handling to capture a substantial amount of business reply mail revenue.

Consequently, there exists a need for an enhanced, automated method of identifying and sorting business reply mail pieces in accordance with plural, predefined levels of refinement in a manner that reduces the required amount of human intervention and increases the amount of revenue collected.

SUMMARY

Various implementations of the invention are concerned with a method of properly identifying the correct parties to whom charges for business reply mail services should be assessed and, furthermore, to sort business reply mail pieces in accordance with a level of refinement for which a predetermined confidence threshold has been met, based on a pre-established protocol including a set of sortation rules, as part of an automated sortation process. By adapting and employing automated mail sortation apparatus to identify and sort business reply mail and, where practicable in accordance with the predetermined protocol, to automatically assess postal charges to the appropriate postal accounts, manual handling, and the cost and potential for errors associated therewith, are substantially reduced.

Various implementations are adapted to identify business reply mail pieces within a postal stream and to sort each business reply mail piece in a manner corresponding to the specificity of the information that can be ascertained about that mail piece by automated address interpretation apparatus and algorithms. For instance, as previously noted, a large corporation that receives large numbers of business reply mail pieces is typically assigned a dedicated, customer-specific reply services postal code. Moreover, at the mail facility (e.g., postal hub) closest the intended delivery point of such mail pieces, a dedicated collection point (e.g., a receptacle such as a sack, crate, bin or cart) is associated with such a high-volume customer and that customer's dedicated reply services postal code. Assuming that a business reply mail piece destined for delivery to such a customer exhibits at least some minimum of information prescribed by a high-level refinement sortation protocol, automated sortation apparatus can sort that mail piece to the appropriate dedicated collection point. Moreover, the mail pieces collected at a dedicated collection point need not be further segregated from the mail pieces of other customer's prior to delivery (i.e., the sortation is "highly refined"). A minimum of information prescribed by the sortation protocol corresponding to a customer associated with a dedicated reply services postal code and collection point is a set of information automatically resolvable by automated address interpretation algorithms that indicates the unique identity of the business reply customer or, more specifically in various embodiments, a particular postal account. For example, under certain conditions, the presence and resolvability of the customer's business reply mail license number and unique business reply mail postal code may be sufficient to uniquely identify the customer and route the corresponding mail piece accordingly. Because a method of automated sortation to a dedicated collection point requires identification of a particular customer account, various implementations also include automated postal charge assessment to such positively identified accounts. Automated charge assessment obviates the need for manual tallying of mail pieces collected at a dedicated collection point, which further reduces the costs and errors associated with human labor.

A less refined, but still very useful, level of business reply mail sortation involves the routing of business reply mail pieces to a shared collection point. A shared collection point is appropriate for business reply mail customers that do not receive a volume of business reply mail large enough to justify the expense and consumption of space associated with dedicated collection points. Typically, each postal customer that shares a collection point with one or more other postal customers, while having a unique account identifier, shares a common business reply mail postal code with at least one other customer. Accordingly, mail pieces properly addressed to plural (i.e., at least two) customers associated with a single shared collection point is intermixed and must be subsequently sorted—typically manually—at least for the purposes of final delivery. If a mail piece destined for a shared collection point includes full and accurate addresses information, or at least a minimum of information prescribed by a sortation protocol, the identity of the customer account to which the associated postal charges are to be assessed may be decipherable by automated address interpretation apparatus and, if decipherable, appropriate charges assessed automatically.

Various implementations accommodate a third type of collection point, namely, a shared collection point that serves as a kind of default for mail pieces determined to be business reply mail, but for which insufficient destination and other information is decipherable or reconcilable with customer account records to determine, with a predetermined desired threshold of confidence, the identity of the customer account to which that mail piece corresponds. Sortation of business reply mail pieces "anonymously" to a shared collection point is less refined than either of the two previously discussed levels of sortation refinement because such mail pieces must be manually segregated and tallied for purposes of delivery to their final destinations and for assessing appropriate charges to corresponding postal accounts.

When a mail piece having a front face exhibiting a destination address field is received into the postal system, a determination is made as to whether that mail piece is business reply mail based on a variety of characteristics exhibited on the front face, for example. In addition to the destination address field, the front face of a mail piece typically includes a stamp indicative of postage paid or other postage-related information (e.g., an indication that the depositor need not apply postage), such as the familiar "No Postage Necessary if Mailed in the United States" associated with business reply mail. If the mail piece is not business reply mail, a return address also commonly appears on the front face. If the mail piece is properly formatted business reply mail, a reply service license identifier appears on the front face. The reply service license identifier includes a permit or license number and is commonly referred to by those skilled in the art as a "business reply license plate" or "response services license plate." The information exhibited in a response service license plate is typically enclosed in a box or between a pair of horizontal heavy lines and includes a phrase such as "BUSINESS REPLY MAIL," and an indication as to the postal facility that issued the license and mail class, in addition to the permit or license number issued to the addressee. Also assisting automated sorting machinery in the identification and orientation of business reply mail is what is referred to as a "facing indicia mark." At least in the United States, facing indicia marks commonly assume the form of a plurality of heavy black horizontal bars on the right hand side of the mail piece front face under the postage-related information. As noted in the background section of this specification, business reply mail pieces may also include a customer-applied bar code that, when properly encoded and applied, identifies the business reply postal code to which the mail piece is to be directed. Because innocent errors, as well as purposeful deception, in the information encoded in a customer bar code result in lost revenue, various implementations deviate from the current postal service practice of automatically accepting as true the information included in a customer bar code and, instead, regard the customer bar code as merely one additional hint in the process of positively identifying the proper customer account against which to assess charges.

In order for automated interpretation apparatus to determine whether a mail piece is business reply mail, how the mail is to be routed for delivery and whether a unique account can be identified for purposes of automated billing, for example, information exhibited on the front face, and perhaps the rear, of the mail piece must be conveyed to the automated interpretation apparatus through mail-piece data acquisition apparatus. The data acquisition apparatus may include, for example, one or more cameras or optical character recognition (OCR) scanners. Although data may be acquired from a mail piece by alternative methods, the act of mail-piece data acquisition is principally expressed throughout the specification and claims in terms of "image capturing" or "image acquisition." Therefore, it is intended that "image capturing" and "image acquisition" and semantic variations thereof, be interpreted sufficiently broadly to include alternative methods of automated data acquisition such as photography and scanning. Accordingly, various implementations include capturing or acquiring at least one image of the front face of the mail piece and storing the at least one image in computer memory. Depending on whether it is desired to preserve the capacity to re-associate the at least one image with the physical mail piece to facilitate future handling, alternative aspects include the steps of marking the physical mail piece with a unique identification mark representing its identity and storing a computer memory record of the identification mark in association with the at least one stored image acquired from the front face of the mail piece. When the capacity to re-associate is not preserved, alternative sortation processes indicate the capture a new image for resolution each time a routing decision must be rendered in association with the automated sortation of the corresponding mail piece.

The at least one captured image acquired from the mail piece is resolved by interpretation algorithms to produce a resolved data set associated with the corresponding physical mail piece and is indicative of information exhibited on the face thereof including, for example, a destination address field, including at least any delivery postal code indicated therein and, if the mail piece is identified as business reply mail, any business reply license number indicated in the business reply license plate. The resolved data set associated with a business reply mail piece may also include indications as to the mail class exhibited on the mail piece and the postal facility that issued the business reply license to the addressee.

Various implementations include the maintenance of reply-services-customer data relating the identity of each business reply postal customer's account(s) with data indicative of at least one of, but typically more than one of (i) a business reply license number, (ii) a business reply postal code assigned to the postal customer in association with that postal customer's license number, (iii) the postal facility that issued the customer's license number, (iv) the street address, including a street address postal code, corresponding to the physical location at which the postal customer receives non-business reply mail, (v) a post office box corresponding to the physical location at which the associated postal customer receives non-business reply mail, (vi) the classes of business reply mail the postal customer is entitled to receive by agreement (vii) a recipient-entity name and (viii) one of a (a) dedicated and (b) shared business-reply-mail-piece collection point (e.g., an indication as to whether that postal customer is associated with a dedicated or shared mail-piece collection point and/or an indication as to the identity and location of the collection point). In various embodiments, this information is maintained for each business reply postal customer of a selected set of business reply postal customers in a response services license database that includes one or more response services license files. The data in the license data base is organized and associated with postal account identifiers such that the more complete and accurate the information appearing on, and acquirable from, a business reply mail piece, and contained in the database entries associated with postal customers, the better the chance that a unique postal account corresponding to that mail piece will be identifiable by automated interpretation apparatus. Under certain circumstances (e.g., as defined by a sortation protocol, an example of which is described further in this description), associated account information facilitates the "correction" and addition of information exhibited by a corresponding physical mail piece so that the mail piece can be properly routed and tracked for at least one of billing and sortation purposes. For instance, if a business reply mail piece exhibits complete and accurate information with the exception that it includes (i) a street address postal code rather than a business reply postal code, (ii) an incorrect or invalid business reply postal code or (iii) no postal code at all, a unique account match may exist in the response services license database that enables automated address interpretation apparatus to associate, through cross-referencing from the data available in the resolved data set associated with the mail piece, the appropriate business reply postal code with the mail piece which, in turn, facilitates at least one of proper sortation and charge-assessment. That is, instead of the mail piece's being sorted in accordance with the street postal code, and bypassing the appropriate business reply mail collection point to which it corresponds, the automated sortation apparatus receives sortation signals generated in accordance with, and including data indicative of, the cross-referenced business reply postal code in order to facilitate automated sortation in accordance therewith. In some instances, the cross-referencing may provide only enough additional information to identify a proper collection point (e.g., a shared collection point) and not necessarily the identity of a unique customer account. In such circumstances, the mail piece is at least routed properly and charge assessment is handled manually, for example, at a later point in time. If the cross-referencing of data renders identifiable a single postal customer account, proper routing as well as automated charge assessment can occur.

An illustrative sortation protocol includes at least a first set of conditions corresponding to a first level of sortation refinement and a second set of conditions corresponding to a second, less refined level of sortation refinement. The first set of conditions includes at least one subset of conditions which, if satisfied by the resolved data set associated with the mail piece, results in the generation of a first set of sortation signals indicating that the mail piece is to be sorted in accordance with the first level of sortation refinement. Analogously, the second set of conditions includes at least one subset of conditions which, if satisfied by the resolved data set associated with the mail piece, results in the generation of a second set of sortation signals indicating that the mail piece is to be sorted in accordance with the second level of sortation refinement.

As to a resolved data set that is identified as relating to a business reply mail piece, the reply-services-customer data is consulted and the resolved data set is compared to the reply-services-customer data in accordance with the sortation protocol in order to determine whether at least one subset of conditions within at least one of the first condition set and the second condition set is satisfied by the resolved data set. If at least one subset of conditions within the first condition set is satisfied by the resolved data set, a first set of sortation signals corresponding to a first level of sortation refinement is caused to be generated in response to the condition satisfaction. If at least one subset of conditions within the second condition set is satisfied by the resolved data set, a second set of sortation signals corresponding to a second level of sortation refinement is caused to be generated in response to the condition satisfaction.

In various implementations, because sortation in accordance with a first, more refined level is regarded as more desirable than sortation in accordance with a second, lesser level of sortation refinement, satisfaction by the resolved data set of at least one condition in each of the first and second condition sets results in the generation of a first set of sortation signals consistent with first level sortation refinement. Accordingly, in order for a mail piece to be sorted in accordance with a second, lesser level of sortation refinement, its corresponding resolved data set must satisfy at least one subset of conditions in the second condition set and no subset of conditions in the first condition set. In other words, the second condition set, in various implementations, includes as a condition subset the non-satisfaction by the resolved data set of a condition subset within the first condition set. In a typical implementation, the resolved data set will first be compared with condition subsets in the first condition set and, if at least one condition in the first condition set is satisfied, no comparisons between the resolved data set and conditions in the second condition set will be executed; the mail piece will simply be sorted in accordance with the first level of sortation refinement by signal-responsive automated sortation apparatus to which the set of sortation signals has been rendered accessible prior to the arrival of the corresponding mail piece at such signal-responsive apparatus.

Although the foregoing has addressed sortation aspects associated primarily with mail pieces already identified as business reply mail, as alluded to above, various aspects are concerned with the identification of business reply mail pieces "in the first instance." That is, a substantial amount of the revenue loss associated with the movement of business reply mail through a postal system results from the failure to distinguish business reply mail pieces from non-business reply mail pieces in the general stream of mail. For example, a mail piece not identified as business reply mail and including no postal code or a street address postal code is frequently sorted and delivered as non-business reply mail, while bypassing revenue collection.

Accordingly, various implementations further include steps for identifying a mail piece having a front face exhibiting at least one of a destination address field and a business reply license plate as one of (i) business reply mail and (ii) non-business-reply mail. A mail piece is received into a postal system and at least one image of the front face is captured and stored in computer memory. An image-capturing step may occur one or more times in any particular implementation and the image(s) captured may, in various implementations, be used for purposes of identification of business reply mail and sortation. The at least one image includes at least one of a (i) destination address field image corresponding to any destination address field that is exhibited on the mail piece and (ii) a business reply license plate image corresponding to any business reply license plate that is exhibited on the mail piece. It is to be understood that the information indicative of a destination address in the address field may be incomplete, but the field including any data indicative of destination and/or recipient is regarded as the destination address field. Similarly, information traditionally associated with that contained in a complete business reply license plate is regarded as part the business reply license plate, regardless of whether complete information is actually exhibited on the mail piece. Moreover, although not previously stated in association with the sortation aspects, but equally applicable thereto, each of various portions of a single image may be alternatively referred to as "an image." For example, in various implementations, a single, all-encompassing image of the front face may be captured and used for all interpretative purposes, and include individual portions referred to as images (e.g., a destination address field image, a business reply license plate image, etc.).

The at least one captured image is algorithmically analyzed by, for example, automated address interpretation algorithms, in order to detect one of (i) the presence and (ii) the absence of data indicative of at least one business-reply-mail signature on the corresponding mail piece and to yield an analyzed-image data set. A non-limiting, illustrative set of business reply mail signatures includes those business reply mail characteristics enumerated above. In addition, the absence of a return address can, in various aspects, provide additional evidence that the mail piece is business reply mail.

Based on the algorithmic analysis of the at least one captured image, a determination is rendered, in accordance with a set or preliminary business-reply-mail-identifying criteria, as to whether the probability that the mail piece to which the at least one captured image corresponds is business reply mail exceeds a predetermined preliminary-threshold probability. The preliminary business-reply-mail-identifying criteria are adaptable to the particular circumstances but may include, for example, consideration of the quantity of business reply mail signatures identified in an image. Also considered may be whether certain combinations of signatures are present. For example, a set of horizontal lines may be disregarded as an anomaly unless some other signature (e.g. "no postage necessary . . . ") also appears. As a general observation, a lower preliminary-threshold probability would typically be satisfied by the presence of fewer business reply mail signatures in the captured image than would a higher preliminary-threshold probability. In still additional versions, the confidence with which business reply mail signatures have been identified is also a factor. The preliminary-threshold probability provides, in essence, a way of rendering a preliminary determination as to whether a mail piece is not business reply mail or is "suspected" of being business-reply mail. In loose, informal parlance, those mail pieces "suspected" of being business repay mail generate sufficient "probable cause" to warrant further investigation into their status. Contrarily, in various implementations, those mail pieces with respect to which the predetermined preliminary-threshold probability is not exceeded are regarded as non-business reply mail and sorted accordingly. That is, they are sorted to at least one collection location designated for the collection of mail pieces regarded as non-business reply mail (e.g., regular, first-class mail).

As to a mail piece with respect to which the preliminary-threshold probability is exceeded, the mail piece is preliminary regarded as business reply mail and the at least one captured image associated with the mail piece is at least partially resolved in order to produce a resolved data set indicative of information exhibited in at least one of (a) any destination address field and (b) any business reply license plate exhibited on the corresponding mail piece. The reply-services-customer data is consulted and detection for correspondence between the data therein and the resolved data set is performed in order to determine whether the probability that the mail piece is business reply mail exceeds a verification-threshold probability. For example, the fact that a record exists in the reply-services-customer data that includes data matching data indicated in the resolved data set, and relating to such information as recipient-entity name, license number and a business reply postal code, for example, increases the likelihood that the mail piece under scrutiny is a business reply mail piece. The reliability of the verification increases with increased correspondence (i.e., matching). In various implementations, a mail piece determined to be business reply mail in accordance with the verification-threshold probability is sorted to a location designated for the collection of mail pieces regarded as business reply mail, while a mail piece relative to which the verification-threshold probability is not exceeded is regarded as non-business reply mail and sorted to a location designated for the collection of mail pieces regarded as non-business reply mail.

Representative implementations are more completely described and depicted in the following detailed description and the accompanying drawings.

BRIEF DESCRIPTION OF THE DRAWINGS

FIGS. A, B and C are operational flowcharts illustrative of current mail flow and sortation through an outward processing center, an inward processing center and a mail delivery office serviced by the inward processing center;

FIG. 4 is an illustrative portion of a business reply license database; and

FIG. 5 is of an illustrative sortation protocol file including condition sets and condition subsets indicative of various levels of automated sortation refinement.

DETAILED DESCRIPTION

Figure 1A:
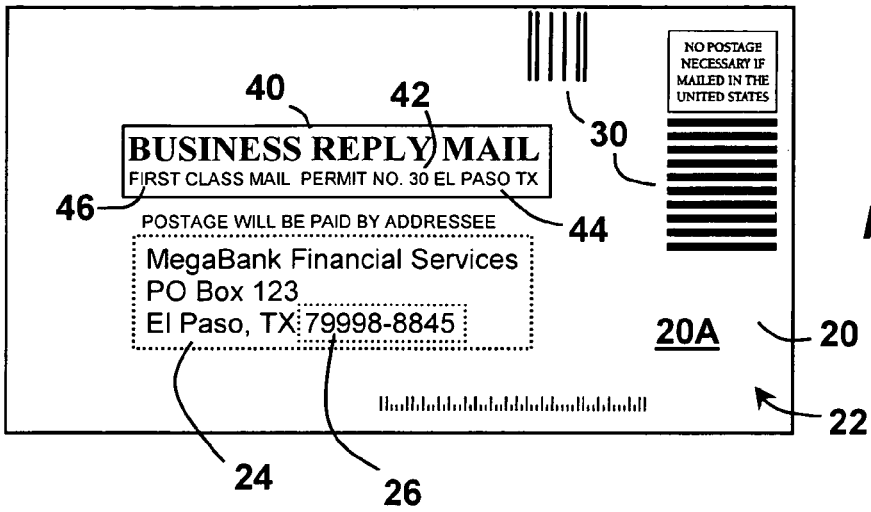
FIG. 1A through 1C depict three illustrative business reply mail pieces.

The following description of business reply mail sortation and charge-assessment processes and architecture, and various implementations thereof, is demonstrative in nature and is not intended to limit the invention or its application of uses. For purposes of illustration, consideration is given to the movement and sortation of three business reply mail pieces sortable in accordance with three levels of sortation refinement.

Referring to FIGS. 1A, 1B, 1C, 2 and 3, the business reply mail pieces 20, individually designated as 20A, 20B and 20C, are entered into the postal system and received at an outgoing mail center 100. For simplicity of explanation, all three mail pieces 20A, 20B and 20C are regarded as having been received at the same outgoing mail center 100 and each corresponds to a postal customer that receives business reply mail in El Paso, Tex. Each business reply mail piece 20 includes a front face 22 having a delivery address field 24 including a postal code 26. Typically, at least in the United States, a five-digit postal code 26—and even as few as the first three digits of such a postal code 26—provides enough information to route a mail piece for transport to the appropriate incoming mail center 200. The remainder of an address field 24 includes more specific information that is required by the incoming mail center 200 to further route the mail piece 20 through a local delivery branch 300 to an addressee and may include street, building, apartment or house number, addressee information and/or "plus 4" and "plus 2" ZIP Code digits. Each of mail pieces 20A, 20B and 20C is identifiable as a business reply mail piece 20 and further exhibits on its front face 22 various business-reply mail-signatures including a facing indicia mark 30, an indication above the facing indicia mark 30 that no postage is necessary if the mail piece 20 is mailed in the United States, a business reply license plate 40 and, below the business reply license plate 40, an indication that "postage will be paid by addressee." The business reply license plate 40 is a field of information which, when correctly composed, at least in the United States, typically includes the addressee's permit/license number 42, an indication as to the license-issuing postal facility 44, a mail-class indication 46 and the phrase "BUSINESS REPLY MAIL."

Figure 1B:
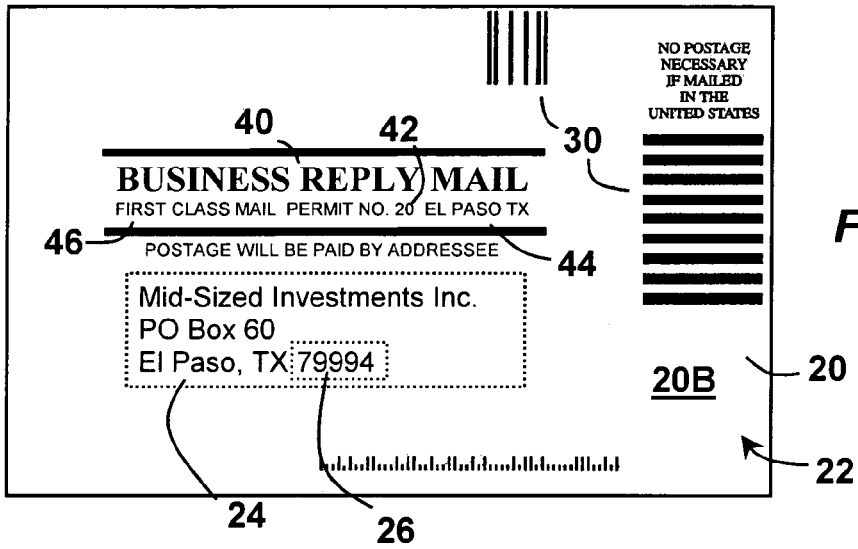
Figure 1C:
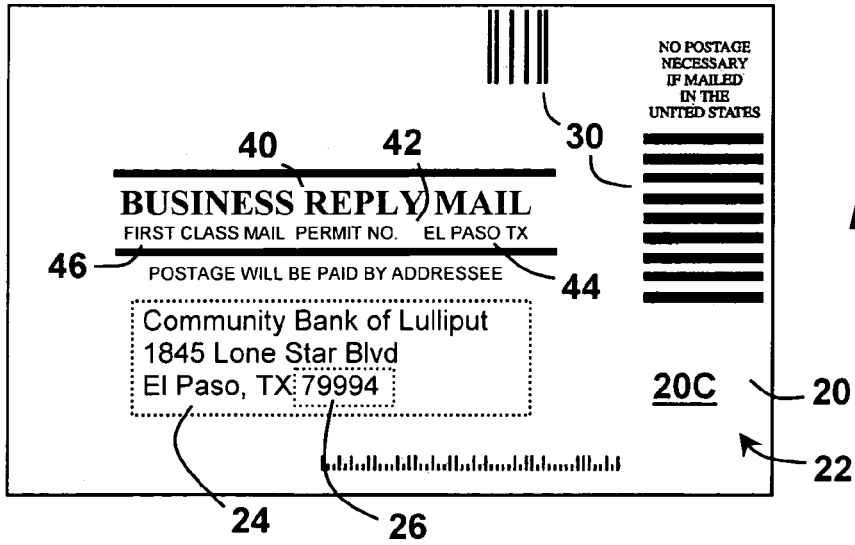
Figure 2:
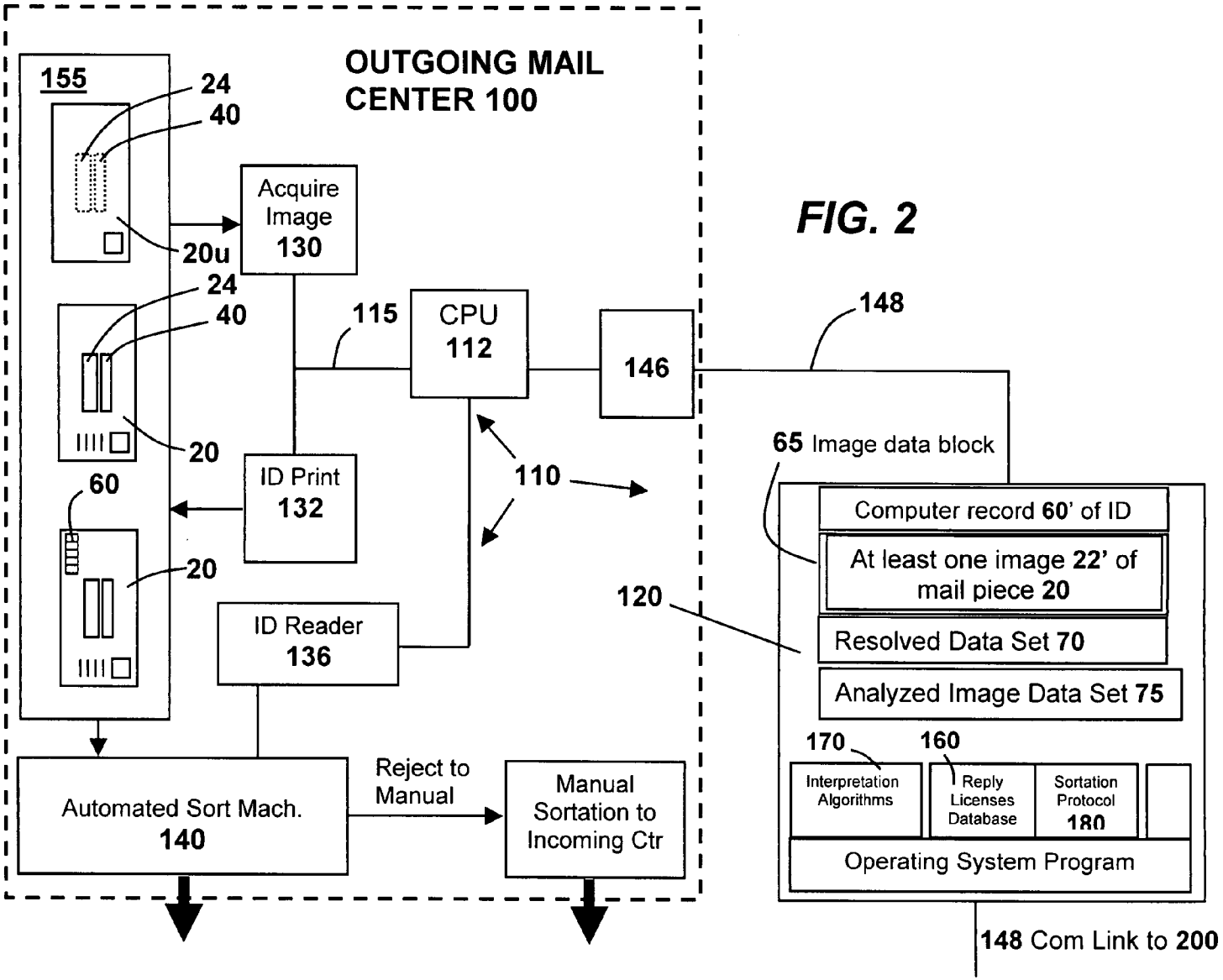
FIG. 2 is a block diagram of an outgoing mail center and architecture for the movement of business reply mail pieces and postal charge assessment associated therewith.

FIG. 2 is a function-block diagram of the architecture at, and accessible to, the illustrative outgoing mail center 100. The outgoing mail center 100 includes access to a data processing system 110, which may be at least partially located outside of the outgoing mail center 100. The data processing system 110 includes a central processing unit (CPU) 112 that is communicatively linked to a memory 120, image acquisition apparatus 130, a printer 132, and an identification-mark reader 136. The system architecture further includes automated sorting machinery 140 and a communications adapter 146 communicatively linked to the CPU 112. The communications adapter 146 communicates via a communications link 148 with various incoming mail centers 200 to which the outgoing mail center 100 sends mail for further processing and, in the particular implementation represented by FIGS. 1 and 2, an offsite memory 120.

At the outgoing mail center 100 of FIG. 2, a mail piece 20 is deposited on a conveyor 155, where it is conveyed passed the image acquisition apparatus 130. The image acquisition apparatus 130 scans and captures at least one image 22' of the front face 22 of the physical mail piece 20 and stores each captured image 22' as a two-dimensional bit plane of pixels, for example, in memory 120. A unique identification mark 60 is associated with the captured image(s) 22' and a computer memory record 60' of the unique identification mark 60 is stored in conjunction therewith in an image data block 65 corresponding to the physical mail piece 20. Typically, the identification mark 60 comprises a bar code, for example. A printer 132 prints the unique identification mark 60 on the physical mail piece 20. The unique identification mark 60 allows the corresponding captured image(s) 22' to be accessed and, when necessary, re-associated with the corresponding physical mail piece 20. The captured image(s) 22' include image data representative of the destination address field 24 and the business reply license plate 40, for example.

While the business reply mail piece 20 to which a set of stored images 22' corresponds is still at the outgoing mail center 100, interpretation algorithms 170 resolve (or interpret) at least enough image data to ascertain the incoming mail center 200 for which the mail piece 20 is destined and to generate sortation signals for the sorting machinery 140 to route the mail piece 20 to an appropriate transport vehicle at the outgoing mail center 100. As image data is resolved, a resolved data set 70 is formed and associated with the computer memory record 60' of the unique identification mark 60. If all of the resolvable image data is not resolved at the time that at least enough image data to ascertain the incoming mail center 200 is resolved, the remainder may be resolved at a later time (e.g., "off-line") while the mail piece 20 is in transit to the next location at which some or all of the remaining resolved data will be required for automated sortation.

In various implementations, a response services license database 160 is provided for maintaining reply-services-customer data accessible to the outgoing and incoming mail centers 100 and 200. The reply services license database 160 contains data relating the identity of each business reply postal account of a selected set of business reply postal accounts with other account-related data from which the identity of the account may be ascertained though automated consultation and cross-referencing. FIG. 4 shows a portion of the data that appears in an illustrative license database 160 relating the identity of each listed account with other data associated with that account. The data associated with each account identifier in the illustrative license database of FIG. 4 includes (i) a business reply license number, (ii) a reply services (RS) postal code, (iii) a street address postal code, (iv) the mail class covered by the account, (v) an indication as to whether the account is associated with a dedicated or shared collection point according to which "0" is indicative of a dedicated collection point and "1" is indicative of a shared collection point and (vi) the postal facility that issued the license associated with the account. As will be more fully explained further in this description, the maintenance of a license database 160 containing data accessible to interpretation algorithms 170 and automated sorting machinery 240 and the incoming mail center 200 facilitates at least one of (i) the accurate sortation of business reply mail pieces 20 that would otherwise be mis-sorted, or at least not automatically sorted in accordance with the highest available level of sortation refinement, and (ii) automated charge-assessment associated with mail pieces 20 passing through mail streams for which charge-assessment is currently handled manually.

Figure 3:
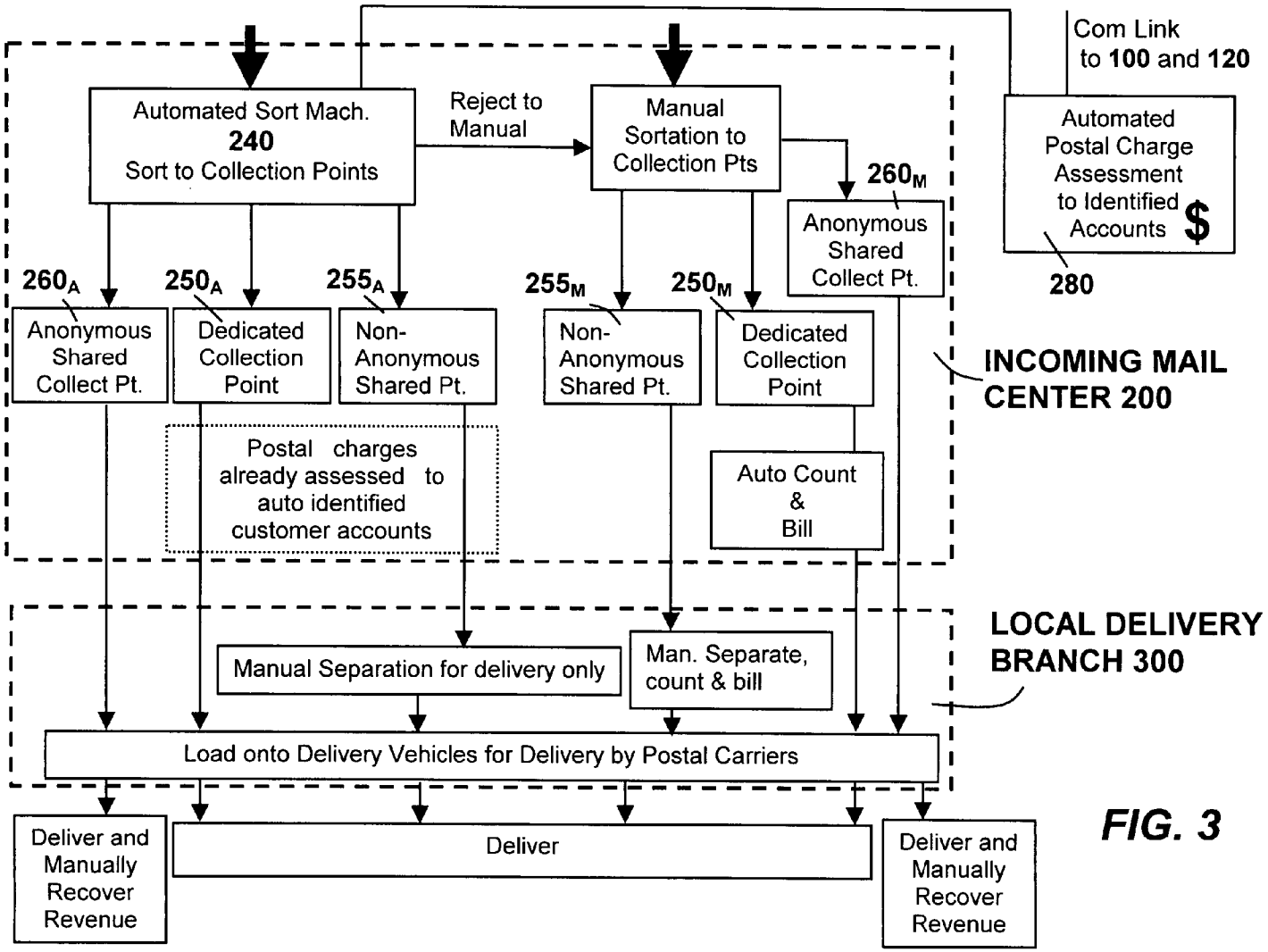
FIG. 3 is a block diagram of an incoming mail center and architecture for the movement of business reply mail pieces and postal charge assessment associated therewith.

In addition to the maintenance of a license database 160, a sortation protocol 180 provides a basis for instructing automated sortation apparatus (e.g., automated sorting machinery 140 and 240) as to how a particular business reply mail piece 20 is to be sorted based on automated consultation with the license database 160 and comparison of data therein with a resolved data set 70 associated with the mail piece 20. Referring to FIGS. 5 and 3, an illustrative sortation protocol 180 includes a first condition set 182 including condition subsets 183$a \rightarrow n$ (collectively referred to as simply "183"), a second condition set 184 including condition subsets 185 and a third condition set 186 including condition subsets 187. The illustrative sortation protocol 180 is structured such that the first condition set 182 corresponds to a first level of sortation refinement. Condition subsets 183 within the first condition set 182 are constructed such that the satisfaction of even a single condition subset 183 positively identifies a single postal customer account and, accordingly, the customer for whom the corresponding mail piece 20 is destined, with a level of confidence exceeding a predetermined first confidence threshold. Satisfaction of a condition subset 183 within the illustrative protocol 180 furthermore corresponds to automated sortation of a mail piece 20 whose resolved data set 70 satisfies the condition subset 183 to a dedicated collection point $\mathbf{250}_A$ within the incoming mail center 200.

The illustrative second condition set 184 corresponds to a second level of sortation refinement that is less refined than the first level of sortation refinement. Satisfaction of a condition subset 185 within the second condition set 184 by the resolved data set 70 associated with a mail piece 20 positively identifies a single postal customer account, and the customer for whom the mail piece 20 is destined, with a level of confidence exceeding a predetermined second confidence threshold. However, in accordance with protocol 180, each mail piece 20 sorted in response to satisfaction of a condition subset 185 is sorted by automated sorting machinery 240 to a shared collection $\mathbf{255}_A$ point that is referred to as "non-anonymous" because the customer account identity is resolved.

The third condition set 186 of the illustrative sortation protocol 180 corresponds to a third level of sortation refinement that is less refined than the second level of sortation refinement. Satisfaction by the resolved data set 70 associated with a mail piece 20 of a condition subset 187 within the third condition set 186, while sufficient to route the mail piece 20 from the outgoing mail center 100 to the incoming mail center 200, for example, is not sufficient to positively identify a single customer account. Accordingly, the mail piece 20 cannot be sorted by the automated sorting machinery 240 to either a dedicated collection point $\mathbf{250}_A$ or a non-anonymous shared collection point $\mathbf{255}_B$ and, therefore, is routed to an "anonymous shared collection point $\mathbf{260}_A$," so referred to because the postal account identity associated with business reply mail pieces 20 routed thereto are not ascertainable in accordance with the protocol 180.

It will be appreciated that the illustrative condition subsets 183, 185 and 187 of condition sets 182, 184 and 186 depicted in FIG. 5 represent a limited, demonstrative and non-limiting selection of numerous condition subsets 183, 185, and 187 that are appropriate to sortation in accordance with, respectively, first, second and third levels of sortation refinement to dedicated, non-anonymous shared and anonymous shared collection points. Depending on the number and nature of the data fields maintained in the license database 160 for cross-reference and comparison to resolved data sets 70, dozens, or even hundreds, of condition subsets 183, 185 and 187 representing various combinations of "matched" data could be defined.

Referring still to FIG. 3, mail pieces 20 "rejected to manual" sortation are manually routed for collection at, depending on the ascertainable information appearing of the mail pieces 20, a dedicated collection point $\mathbf{250}_M$, a non-anonymous shared collection point $\mathbf{255}_M$ or an anonymous collection point $\mathbf{260}_M$. Mail pieces 20 handled manually at the incoming mail center 200 are handled and routed in a manner similar to the manner in which mail pieces are manually handled and routed at the inward processing center depicted in FIG. A. However, mail pieces 20 sorted and routed by automated sorting machinery 240 at the incoming mail center 200 to dedicated and non-anonymous shared collection points $\mathbf{250}_A$ and $\mathbf{255}_A$ are treated differently from mail pieces automatically sorted and routed at the inward processing center shown in FIG. A.

Referring to FIG. A and, more particularly, to the automated sort side of the inward processing center, mail pieces destined for non-anonymous shared collection points (i.e., RS Non-Direct Selection) are manually separated, counted and billed. Mail pieces destined for dedicated collection points (i.e., RS Direct Selection) are countable by machines, but only after they have been sorted and collected at the dedicated collection point. In either case, mail-piece counting and billing in the scheme represented in FIG. A is a post-sortation operation. Distinguishably, in various implementations, including that represented in FIG. 3, postal charge assessment is automated in connection with mail pieces 20 for which the associated customer account is identified through comparison of a resolved data set 70 with data maintained in the license database 160 for routing purposes. 1n other words, in various aspects, the very scheme that is employed, for example, to "correct" the routing of a mail piece 20 exhibiting a street postcode to routing in accordance with the proper business reply postcode by cross-reference, through postal account identification in the license data base 160, provides a basis for assessing postal charges to the identified account. Accordingly, postal charges can be assessed for the delivery of each mail piece 20 destined for either a dedicated collection point or a non-anonymous shared collection point before the physical mail piece 20 arrives at its designated collection point, for example. Reliance upon a resolved data set 70 associated with a mail piece 20 facilitates postal charge assessment while the mail piece 20 is being sorted at any time after positive identification of the postal account with which that mail piece 20 is associated including, for instance, immediately following the initial image data acquisition from the mail piece 20 at an outgoing mail center 100. Automated billing for delivery of business reply mail pieces 20 through even just the two mail streams indicated in FIG. 3 translates to substantial reduction in manual handling. Moreover, the "correction" in the routing of business reply mail pieces 20 in accordance with cross-referenced business reply postal codes obviates the "rejection to manual sortation" of substantial quantities of mail that would otherwise require manual handling. Implicit in the preceding observation is that, when a proper business reply postal code cannot be cross-referenced, the mail piece 20 is, in various implementations, sorted to a collection in designated for the collection of mail pieces 20 relative to which a business reply mail postal code cannot be cross-referenced such as, by way of non-limiting example, a manual sortation area.

In order to further facilitate understanding of the implementation and aspects depicted in FIGS. 2 through 5, reference is made to the business reply mail pieces 20 depicted in FIGS. 1A through 1C, and a brief explanation is provided as to how each of the three mail pieces 20A, B and C would be processed in the incoming mail center 200 of FIG. 3. Referring to mail piece 20A, the postal code 26 exhibited in the address field 24 is "79998-8845" and the business reply license plate indicates "PERMIT NO. 30" issued in El Paso, Tex. for first class mail. At some point during the processing of this mail piece 20A by the automated sorting machinery 240, the unique identification mark 60 is scanned to "call up" from memory 120 the resolved data set 70 associated with the computer memory record 60' of the unique identification mark 60 exhibited on mail piece 20A. The data contained in the resolved data set 70 is then compared to data listed in the reply license data base 160 in accordance with the sortation protocol 180. Referring to FIG. 4, the illustrative reply license data base 160 includes a unique account identification match between the data that would be included in a complete resolved data set 70 corresponding to mail piece 20A and data associated with the account identification. The unique match indicates that the corresponding account identification is "1A0001" and that dedicated collection point 250A is associated with the account. With the account identification positively resolved, a signal is communicated to the automated postal charge assessment apparatus 280 shown in FIG. 3 and an appropriate charge is assessed to account "1A001." The sortation protocol 180, shown in FIG. 5, indicates that the mail piece 20A is to be sorted to dedicated collection point 250A because condition subset 183A is satisfied. Accordingly, appropriate sortation signals are generated and rendered accessible to the automated sorting machinery 240 and the mail piece 20A is routed for the dedicated collection point 250A.

A process analogous to the process described in connection with mail piece 20A applies to mail piece 20B. Assuming a fully resolved data set 70 is available to the automated sorting machinery 240, a comparison of the resolved data set 70 associated with mail piece 20B also indicates a unique match with an account identification (i.e., account ID 1B0002) in the reply license data base 160, despite the fact that mail piece 20B exhibits a street postal code instead of a business reply postal code. The collection point data indicates that a shared collection point is associated with account identification 1B0002. Consultation with sortation protocol 180 depicted in FIG. 5 indicates that condition subset 185D is satisfied and that, at least in the resolved data set 70 associated with mail piece 20B, the postcode is to be "corrected" to the corresponding business reply postcode associated with the unique match in the reply license data base 160 (i.e., business reply post code 79995-2233). Sortation signals consistent with the business reply postal code are then generated and rendered accessible to the automated sorting machinery 240 such that mail piece 20B is routed for the non-anonymous shared collection point 255A. Moreover, because a single postal account was been identified, a signal is communicated to the automated postal charge assessment apparatus 280 shown in FIG. 3 and an appropriate charge is assessed to account "1B002."

Referring to FIG. 1C, business reply mail piece 20C exhibits a street postal code and no license number. Three account identifications in the business reply license data base 160 correspond to the data that would be included in a complete resolved data set 70 associated with mail piece 20C; namely, account identifications 1A001, 1B0002 and D60006. Accordingly, the resolved data is insufficient to positively identify which account is associated with mail piece 20. Because condition subset 187A in condition set 186 of protocol 180 is satisfied, a set of sortation signals is generated and rendered accessible to the automated sortation machinery 240 according to which signals the mail piece 20C is routed to anonymous shared collection point 260A. No automated charge assessment occurs because the appropriate account identification is not resolvable.

As discussed in the summary above, various implementations further include steps for identifying a mail piece as one of (i) business reply mail and (ii) non-business-reply mail. An illustrative mail piece identification method is currently described in conjunction with FIG. 2. A mail piece 20*u* of initially unknown identity as either business reply mail or non-business reply mail enters the outgoing mail center 100. The mail piece 20*u* exhibits at least one of a destination address field 24 and a business reply license plate 40.

At least one image of the mail piece 20*u* is captured and stored in computer memory (shown as 22' in FIG. 2). The captured image(s) 22' include image data representative of the destination address field 24 and the business reply license plate 40. The image data corresponding to each has previously been referred to, respectively, as a destination address field image (not labeled) corresponding to any destination address field that is exhibited on the mail piece and (ii) a business reply license plate image (not labeled) corresponding to any business reply license plate that is exhibited on the mail piece.

The at least one captured image 22' is algorithmically analyzed by, for example, automated address interpretation algorithms 170, in order to detect one of (i) the presence and (ii) the absence of data indicative of at least one business-reply-mail signature on the corresponding mail piece 20*u* and to yield an analyzed-image data set 75. A non-limiting, illustrative set of business reply mail signatures includes, as previously described in association with FIGS. 1A, 1B and 1C, a facing indicia mark 30, an indication above the facing indicia mark 30 that no postage is necessary if the mail piece 20 is mailed in the United States, a business reply license plate 40 and, below the business reply license plate 40, an indication that "postage will be paid by addressee."Based on the algorithmic analysis of the at least one captured image 22', a determination is rendered, in accordance with a set of preliminary business-reply-mail-identifying criteria, as to whether the probability that the mail piece 20*u* to which the at least one captured image 22' corresponds is a business reply mail piece 20 exceeds a predetermined preliminary-threshold probability.

As to a mail piece 20*u* with respect to which the preliminary-threshold probability is exceeded, the mail piece 20*u* is preliminary regarded as a business reply mail piece 20 and the at least one captured image 22' associated with the mail piece 20*u* is at least partially resolved in order to produce a resolved data set 70 indicative of information exhibited in at least one of (a) any destination address field 24 and (b) any business reply license plate 40 exhibited on the corresponding mail piece 20*u*.The reply-services-customer data 160 is consulted and detection for correspondence between the data therein and the resolved data set 70 is performed in order to determine whether the probability that the mail piece 20*u* is a business reply mail piece 20 exceeds a verification-threshold probability. In various implementations, a mail piece 20*u* determined to be a business reply mail piece 20 in accordance with the verification-threshold probability is sorted in accordance with a method as previously described.

The foregoing is considered to be illustrative of the principles of the invention. Furthermore, since modifications and changes will occur to those skilled in the art without departing from the scope and spirit of the invention, it is to be understood that the foregoing does not limit the invention as expressed in the appended claims to the exact construction, implementations and versions shown and described.

What is claimed is:

1. A method of identifying and sorting a mail piece having a front face exhibiting at least one of a destination address field and a business reply license plate as one of (i) business reply mail and (ii) non-business-reply mail, the method comprising the steps of:

capturing at least one image of the front face and storing the at least one image in computer memory, the at least one image including at least one of a (i) destination address field image corresponding to any destination address field on the mail piece and (ii) a business reply license plate image corresponding to any business reply license plate on the mail piece;

algorithmically analyzing the at least one captured image in order to detect one of (i) the presence and (ii) the absence of data indicative of at least one business-reply-mail signature on the corresponding mail piece, the algorithmic analysis yielding an analyzed-image data set;

determining, based on the algorithmic analysis of the at least one captured image, and in accordance with a set of preliminary business-reply-mail-identifying criteria, whether the probability that the mail piece to which the at least one captured image corresponds is business reply mail exceeds a predetermined preliminary-threshold probability;

maintaining reply-services-customer data relating the identity of each business reply postal customer account of a selected set of business reply postal customer accounts with data indicative of at least one of (i) a business reply license number, (ii) a business reply postal code, (iii) a street address corresponding to the physical location at which the associated postal customer receives non-business-reply mail, (iv) a post office box corresponding to the physical location at which the associated postal customer receives non-business-reply mail, (v) a recipient-entity name, (vi) the postal facility that issued the license number, (vii) a class of business reply mail that the postal customer is entitled to receive and (viii) one of a (a) dedicated and (b) shared business-reply-mail-piece collection point; and one of (i) regarding the mail piece as non-business reply mail if the probability that the mail piece to which the at least one analyzed image corresponds is determined not to exceed the predetermined preliminary-threshold probability, and sorting the mail piece to a location designated for the collection of mail pieces regarded as non-business reply mail; and (ii) if the probability that the mail piece to which the at least one analyzed image corresponds is determined to exceed the predetermined preliminary threshold probability, resolving, at least partially, the at least one captured image associated with the mail piece in order to produce a resolved data set associated with the mail piece and indicative of information exhibited in at least one of (a) any destination address field and (b) any business reply license plate on the corresponding mail piece and consulting the reply-services-customer data in order to determine, by the detection of correspondence between the data therein and the resolved data set, whether the probability that the mail piece is business reply mail exceeds a verification-threshold probability; wherein (i) as to a mail piece relative to which the verification-threshold probability is not exceeded, the method further comprises regarding the mail piece as non-business reply mail and sorting the mail piece to a location designated for the collection of mail pieces regarded as non-business reply mail; and (ii) as to a mail piece determined to be business reply mail in accordance with the verification-threshold probability, sorting the mail piece to a location designated for the collection of mail pieces regarded as business reply mail.

2. The method of claim 1 further comprising, relative to a mail piece determined to be business reply mail in accordance with the verification-threshold probability, comparing the resolved data set associated with the mail piece to the consulted reply-services-customer data in order to determine whether, through cross-referencing, a unique postal customer account match exists for purposes of automated charge assessment; and one of (i) automatically assessing a postal charge to the customer account if a unique postal customer account match exists, and (ii) sorting the mail piece to a collection point designated for the collection of business-reply mail pieces for which an associated customer account is not ascertainable by consulting the reply-services-customer data.

3. The method of claim 1 wherein, as to a mail piece determined to be business reply mail in accordance with the verification-threshold probability, the method further comprises:

providing a sortation protocol including at feast a first condition set and a second condition set, the first condition set corresponding to a first level of sortation refinement such that, if at least one subset of conditions within the first condition set is satisfied by the resolved data set associated with the mail piece, a first set of sortation signals is generated indicating that the mail piece is to be sorted in accordance with the first level of sortation refinement and the second condition set corresponding to a second level of sortation refinement such that, if at least one subset of conditions within the second condition set is satisfied by the resolved data set associated with the mail piece, a second set of sortation signals is generated indicating that the mail piece is to be sorted in accordance with the second level of sortation refinement, the second level of sortation refinement being less refined than the first level of sortation refinement;

consulting the reply-services-customer data and comparing the resolved data set to the reply-services-customer data in accordance with the sortation protocol in order to determine whether at least one subset of conditions within at least one of the first condition set and the second condition set is satisfied by the resolved data set;

causing the generation of one of (i) a first set of sortation signals in response to the satisfaction, by the resolved data set, of at least one subset of conditions within the first condition set and (ii) a second set of sortation signals in response to the satisfaction, by the resolved data set, of a least one subset of conditions within the second condition set, but not within the first condition set;

rendering accessible to predetermined, signal-responsive sortation apparatus the generated set of sortation signals prior to the arrival of the corresponding mail piece at the signal-responsive sortation apparatus; and sorting the mail piece to a collection point in response to the generated set of sortation signals.

4. The method of claim 3 wherein the satisfaction by the resolved data set of at least one subset of conditions within the first condition set indicates that a single business reply customer for whom the corresponding mail piece is destined, and with whom one of (i) a dedicated and (ii) a shared mail-piece collection point is associated, has been identified with a level of confidence exceeding a predetermined first confidence threshold and wherein the satisfaction of at least one condition within the second condition set, but not within the first condition set, indicates that a shared mail-piece collection point for which the corresponding mail piece is destined has been identified with a level of confidence exceeding a predetermined second confidence threshold, a shared mail-piece collection point being a collection point associated with two or more business reply postal customer accounts.

5. The method of claim 4 further comprising comparing the resolved data set associated with the mail piece to the consulted reply-services-customer data in order to determine whether, through cross-referencing, a unique postal customer account match exists for purposes of automated charge assessment; and one of (i) automatically assessing a postal charge to the customer account if a unique postal customer account match exists, and (ii) sorting the mail piece to a collection point designated for the collection of business-reply mail pieces for which an associated customer account is not ascertainable by consulting the reply-services-customer data.

6. The method of claim 3 wherein, when the destination address field exhibits at least one of (i) no postal code (ii) an incorrect business reply postal code and (iii) a street address postal code instead of a business reply postal code, the method further comprises:

comparing the resolved data set associated with the mail piece to the reply-services-customer data in order to determine whether, through cross-referencing, at least one of (i) an appropriate business reply postal code can be associated with the mail piece for purposes of automated routing to a proper mail-piece collection point and (ii) a unique postal customer account match exists for purposes of automated charge assessment; and at least one of (a) (i) as to a mail piece relative to which an appropriate business reply postal code can be cross-referenced, causing the generation of sortation signals including data indicative of the cross-referenced business reply postal code and automatically sorting the mail piece to a collection point in response to the set of sortation signals generated in accordance with the cross-referenced business reply postal code, and (ii) as to a mail piece relative to which an appropriate business reply postal code cannot be cross-referenced, sorting the mail piece to a collection point designated for the collection of mail pieces relative to which a business reply postal code cannot be cross-referenced; and (b) one of (i) automatically assessing a postal charge to the customer account if a unique postal customer account match exists, and (ii) sorting the mail piece to a collection point designated for the collection of business-reply mail pieces for which an associated customer account is not ascertainable by consulting the reply-services-customer data.

7. The method of claim 3 wherein the predetermined levels of sortation refinement include at least first, second and third levels of automated sortation refinement and wherein:

(i) the first level of automated sortation refinement corresponds to the automated sortation of a business reply mail piece to a dedicated mail-piece collection point associated with a postal account of a single business reply mail customer ascertainable by consulting the reply-services-customer data;

(ii) the second level of automated sortation refinement corresponds to the automated sortation of a business reply mail piece to a non-anonymous shared collection point associated with at least two business reply mail customer accounts ascertainable by consulting the reply-services-customer data, and (iii) the third level of sortation refinement corresponds to the automated sortation of a business reply mail piece to an anonymous shared collection point designated for the collection of mail pieces for which an associated customer account is not ascertainable by consulting the reply-services-customer data.

8. The method of claim 7 further comprising the step of automatically assessing a postal charge to the customer account corresponding to each business reply mail piece of a selected set of business reply mail pieces the associated resolved data set of which satisfies one of (i) a subset of conditions within the first condition set corresponding to the first level of sortation refinement and (ii) a subset of conditions within the second condition set corresponding to the second level of sortation refinement.

9. The method of claim 7 further comprising comparing the resolved data set associated with the mail piece to the consulted reply-services-customer data in order to determine whether, through cross-referencing, a unique postal customer account match exists for purposes of automated charge assessment; and one of (i) automatically assessing a postal charge to the customer account if a unique postal customer account match exists, and (ii) sorting the mail piece to a collection point designated for the collection of business-reply mail pieces for which an associated customer account is not ascertainable by consulting the reply-services-customer data.

10. The method of claim 7 wherein, when the destination address field exhibits at least one of (i) no postal code (ii) an incorrect business reply postal code and (iii) a street address postal code instead of a business reply postal code, the method further comprises:

comparing the resolved data set associated with the mail piece to the reply-services-customer data in order to determine whether, through cross-referencing, at least one of (i) an appropriate business reply postal code can be associated with the mail piece for purposes of automated routing to a proper mail-piece collection point and (ii) a unique postal customer account match exists for purposes of automated charge assessment; and at least one of (a) (i) as to a mail piece relative to which an appropriate business reply postal code can be cross-referenced, causing the generation of sortation signals including data indicative of the cross-referenced business reply postal code and automatically sorting the mail piece to a collection point in response to the set of sortation signals generated in accordance with the cross-referenced business reply postal code, and (ii) as to a mail piece relative to which an appropriate business reply postal code cannot be cross-referenced, sorting the mail piece to a collection point designated for the collection of mail pieces relative to which a business reply postal code cannot be cross-referenced; and (b) one of (i) automatically assessing a postal charge to the customer account if a unique postal customer account match exists, and (ii) sorting the mail piece to a collection point designated for the collection of business-reply mail pieces for which an associated customer account is not ascertainable by consulting the reply-services-customer data.

11. A method of sorting, within a postal system, a mail piece identifiable as business reply mail in accordance with one of at least two predefined levels of sortation refinement, the mail piece having a front face including at least one of (i) a destination address field and (ii) a business reply license plate, the method comprising the steps of:

capturing at least one image of the front face and storing the at least one image in computer memory, the at least one image including at least one of a (i) destination address field image corresponding to any destination address field on the mail piece and (ii) a business reply license plate image corresponding to any business reply license plate on the mail piece;

marking the mail piece with a unique identification mark representing its identity and storing a computer memory record of the identification mark in association with the at least one stored image from the front face;

maintaining reply-services-customer data relating the identity of each business reply postal customer account of a selected set of business reply postal customer accounts with data indicative of at least one of (i) a business reply license number, (ii) a business reply postal code, (iii) a street address corresponding to the physical location at which the associated postal customer receives non-business-reply mail, (iv) a post office box corresponding to the physical location at which the associated postal customer receives non-business-reply mail, (v) a recipient-entity name, (vi) the postal facility that issued the license number, (vii) a class of business reply mail that the postal customer is entitled to receive and (viii) one of a (a) dedicated and (b) shared business-reply-mail-piece collection point;

resolving, at least partially, the at least one captured image associated with the mail piece to produce a resolved data set associated with the mail piece and indicative of information exhibited in at least one of (i) any destination address field and (ii) any business reply license plate on the corresponding mail piece;

providing a sortation protocol including at least a first condition set and a second condition set, the first condition set corresponding to a first level of sortation refinement such that, if at least one subset of conditions within the first condition set is satisfied by the resolved data set associated with the mail piece, a first set of sortation signals is generated indicating that the mail piece is to be sorted in accordance with the first level of sortation refinement and the second condition set corresponding to a second level of sortation refinement such that, if at least one subset of conditions within the second condition set is satisfied by the resolved data set associated with the mail piece, a second set of sortation signals is generated indicating that the mail piece is to be sorted in accordance with the second level of sortation refinement, the second level of sortation refinement being less refined than the first level of sortation refinement;

consulting the reply-services-customer data and comparing the resolved data set to the reply-services-customer data in accordance with the sortation protocol in order to determine whether at least one subset of conditions within at least one of the first condition set and the second condition set is satisfied by the resolved data set;

causing the generation of one of (i) a first set of sortation signals in response to the satisfaction, by the resolved data set, of at least one subset of conditions within the first condition set and (ii) a second set of sortation signals in response to the satisfaction, by the resolved data set, of a least one subset of conditions within the second condition set, but not within the first condition set;

rendering accessible to predetermined, signal-responsive sortation apparatus the generated set of sortation signals prior to the arrival of the corresponding mail piece at the signal-responsive sortation apparatus; and sorting the mail piece to a collection point in response to the generated set of sortation signals.

12. The method of claim 11 wherein the satisfaction by the resolved data set of at least one subset of conditions within the first condition set indicates that a single business reply customer for whom the corresponding mail piece is destined, and with whom one of (i) a dedicated and (ii) a shared mail-piece collection point is associated, has been identified with a level of confidence exceeding a predetermined first confidence threshold and wherein the satisfaction of at least one condition within the second condition set, but not within the first condition set, indicates that a shared mail-piece collection point for which the corresponding mail piece is destined has been identified with a level of confidence exceeding a predetermined second confidence threshold, a shared mail-piece collection point being a collection point associated with two or more business reply postal customer accounts.

13. The method of claim 12 further comprising comparing the resolved data set associated with the mail piece to the consulted reply-services-customer data in order to determine whether, through cross-referencing, a unique postal customer account match exists for purposes of automated charge assessment; and one of (i) automatically assessing a postal charge to the customer account if a unique postal customer account match exists, and (ii) sorting the mail piece to a collection point designated for the collection of business-reply mail pieces for which an associated customer account is not ascertainable by consulting the reply-services-customer data.

14. The method of claim 11 wherein, when the destination address field exhibits at least one of (i) no postal code (ii) an incorrect business reply postal code and (iii) a street address postal code instead of a business reply postal code, the method further comprises:

comparing the resolved data set associated with the mail piece to the reply-services-customer data in order to determine whether, through cross-referencing, at least one of (i) an appropriate business reply postal code can be associated with the mail piece for purposes of automated routing to a proper mail-piece collection point and (ii) a unique postal customer account match exists for purposes of automated charge assessment: and at least one of (a) (i) as to a mail piece relative to which an appropriate business reply postal code can be cross-referenced, causing the generation of satiation signals including data indicative of the cross-referenced business reply postal code and automatically sorting the mail piece to a collection point in response to the set of sortation signals generated in accordance with the cross-referenced business reply postal code, and (ii) as to a mail piece relative to which an appropriate business reply postal code cannot be cross-referenced, sorting the mail piece to a collection point designated for the collection of mail pieces relative to which a business reply postal code cannot be cross-referenced; and (b) one of (i) automatically assessing a postal charge to the customer account if a unique postal customer account match exists, and (ii) sorting the mail piece to a collection point designated for the collection of business-reply mail pieces for which an associated customer account is not ascertainable by consulting the reply-services-customer data.

15. The method of claim 11 wherein the predetermined levels of sortation refinement include at least first, second and third levels of automated sortation refinement and wherein:

(i) the first level of automated sortation refinement corresponds to the automated sortation of a business reply mail piece to a dedicated mail-piece collection point associated with a postal account of a single business reply mail customer ascertainable by consulting the reply-services-customer data;

(ii) the second level of automated sortation refinement corresponds to the automated sortation of a business reply mail piece to a non-anonymous shared collection point associated with at least two business reply mail customer accounts ascertainable by consulting the reply-services-customer data; and (iii) the third level of sortation refinement corresponds to the automated sortation of a business reply mail piece to an anonymous shared collection point designated for the collection of mail pieces for which an associated customer account is not ascertainable by consulting the reply-services-customer data.

16. The method of claim 15 further comprising the step of automatically assessing a postal charge to the customer account corresponding to each business reply mail piece of a selected set of business reply mail pieces the associated resolved data set of which satisfies one of (i) a subset of conditions within the first condition set corresponding to the first level of sortation refinement and (ii) a subset of conditions within the second condition set corresponding to the second level of sortation refinement.

17. A method of identifying and sorting a mail piece having a front face exhibiting at least one of a destination address field and a business reply license plate as one of (i) business reply mail and (ii) non-business-reply mail, the method comprising the steps of:

capturing at least one image of the front face and storing the at least one image in computer memory, the at least one image including at least one of a (i) destination address field image corresponding to any destination address field on the mail piece and (ii) a business reply license plate image corresponding to any business reply license plate on the mail piece;

algorithmically analyzing the at least one captured image in order to detect one of (i) the presence and (ii) the absence of data indicative of at least one business-reply-mail signature on the corresponding mail piece, the algorithmic analysis yielding an analyzed-image data set;

determining, based on the algorithmic analysis of the at least one captured image, and in accordance with a set of preliminary business-reply-mail-identifying criteria, whether the probability that the mail piece to which the at least one captured image corresponds is business reply mail exceeds a predetermined preliminary-threshold probability;

maintaining reply-services-customer data relating the identity of each business reply postal customer account of a selected set of business reply postal customer accounts with data indicative of at least one of (i) a business reply license number, (ii) a business reply postal code, (iii) a street address corresponding to the physical location at which the associated postal customer receives non-business-reply mail, (iv) a post office box corresponding to the physical location at which the associated postal customer receives non-business-reply mail, (v) a recipient-entity name, (vi) the postal facility that issued the license number, (vii) a class of business reply mail that the postal customer is entitled to receive and (viii) one of a (a) dedicated and (b) shared business-reply-mail-piece collection point;

regarding the mail piece as non-business reply mail if the probability that the mail piece to which the at least one analyzed image corresponds is determined not to exceed the predetermined preliminary-threshold probability and sorting the mail piece to a location designated for the collection of mail pieces regarded as non-business reply mail; and preliminary regarding the mail piece as business reply mail if the probability that the mail piece to which the at least one analyzed image corresponds is determined to exceed the predetermined preliminary-threshold probability; wherein, as to a mail piece preliminary regarded as business reply mail, the method further comprises:

resolving, at least partially, the at least one captured image associated with the mail piece in order to produce a resolved data set associated with the mail piece and indicative of information exhibited in at least one of (a) any destination address field and (b) any business reply license plate on the corresponding mail piece and consulting the reply-services-customer data in order to determine, by the detection of correspondence between the data therein and the resolved data set, whether the probability that the mail piece is business reply mail exceeds a verification-threshold probability, and wherein (i) as to a mail piece relative to which the verification-threshold probability is not exceeded, the method further comprises regarding the mail piece as non-business reply mail and sorting the mail piece to a collection point designated for the collection of mail pieces regarded as non-business reply mail and (ii) as to a mail piece determined to be business reply mail in accordance with the verification-threshold probability, the method further comprises:

providing a sortation protocol including at least a first condition set and a second condition set, the first condition set corresponding to a first level of sortation refinement such that, if at least one subset of conditions within the first condition set is satisfied by the resolved data set associated with the mail piece, a first set of sortation signals is generated indicating that the mail piece is to be sorted in accordance with the first level of sortation refinement and the second condition set corresponding to a second level of sortation refinement such that, if at least one subset of conditions within the second condition set is satisfied by the resolved data set associated with the mail piece, a second set of sortation signals is generated indicating that the mail piece is to be sorted in accordance with the second level of sortation refinement, the second level of sortation refinement being less refined than the first level of sortation refinement;

consulting the reply-services-customer data and comparing the resolved data set to the reply-services-customer data in accordance with the sortation protocol in order to determine whether at least one subset of conditions within at least one of the first condition set and the second condition set is satisfied by the resolved data set;

causing the generation of one of (i) a first set of sortation signals in response to the satisfaction, by the resolved data set, of at least one subset of conditions within the first condition set and (ii) a second set of sortation signals in response to the satisfaction, by the resolved data set, of a least one subset of conditions within the second condition set, but not within the first condition set; and rendering accessible to predetermined, signal-responsive sortation apparatus the generated one of the first and second sets of sortation signals prior to the arrival of the corresponding mail piece at the signal-responsive sortation apparatus and sorting the mail piece to a collection point in response to the generated one of the first and second sets of sortation signals.

18. The method of claim 17 further comprising, relative to a mail piece determined to be business reply mail in accordance with the verification-threshold probability, comparing the resolved data set associated with the mail piece to the consulted reply-services-customer data in order to determine whether, through cross-referencing, a unique postal customer account match exists for purposes of automated charge assessment; and one of (i) automatically assessing a postal charge to the customer account if a unique postal customer account match exists, and (ii) sorting the mail piece to a collection point designated for the collection of business-reply mail pieces for which an associated customer account is not ascertainable by consulting the reply-services-customer data.

19. The method of claim 17 wherein the satisfaction by the resolved data set of at least one subset of conditions within the first condition set indicates that a single business reply customer for whom the corresponding mail piece is destined, arid with whom one of (i) a dedicated and (ii) a shared mail-piece collection point is associated, has been identified with a level of confidence exceeding a predetermined first confidence threshold and wherein the satisfaction of at least one condition within the second condition set, but not within the first condition set, indicates that a shared mail-piece collection point for which the corresponding mail piece is destined has been identified with a level of confidence exceeding a predetermined second confidence threshold, a shared mail-piece collection point being a collection point associated with two or more business reply postal customer accounts.

20. The method of claim 19 further comprising, relative to a mail piece determined to be business reply mail in accordance with the verification-threshold probability, comparing the resolved data set associated with the mail piece to the consulted reply-services-customer data in order to determine whether, through cross-referencing, a unique postal customer account match exists for purposes of automated charge assessment; and one of (i) automatically assessing a postal charge to the customer account if a unique postal customer account match exists, and (ii) sorting the mail piece to a collection point designated for the collection of business-reply mail pieces for which an associated customer account is not ascertainable by consulting the reply-services-customer data.

* * * * *